US008019243B2

(12) United States Patent
Kinukawa et al.

(10) Patent No.: US 8,019,243 B2
(45) Date of Patent: Sep. 13, 2011

(54) IMAGE FORMING APPARATUS WITH CONTROL OF IMAGE FORMING CONDITION

(75) Inventors: Tatsuya Kinukawa, Mishima (JP); Kimitaka Ichinose, Suntou-gun (JP); Tomoaki Nakai, Numazu (JP); Takao Kume, Yokohama (JP); Hiroyuki Seki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 93 days.

(21) Appl. No.: 12/463,527

(22) Filed: May 11, 2009

(65) Prior Publication Data

US 2009/0297182 A1 Dec. 3, 2009

(30) Foreign Application Priority Data

May 27, 2008 (JP) ..... 2008-138048
Apr. 6, 2009 (JP) ..... 2009-092313

(51) Int. Cl.
*G03G 15/00* (2006.01)

(52) U.S. Cl. ..... 399/43; 399/44; 399/50; 399/55; 399/82

(58) Field of Classification Search ..... 399/43, 399/50, 53, 55, 44, 82
See application file for complete search history.

(56) References Cited

U.S. PATENT DOCUMENTS

| | | | | |
|---|---|---|---|---|
| 5,543,904 | A | 8/1996 | Kato et al. | 399/335 |
| 5,708,915 | A * | 1/1998 | Noguchi et al. | 399/50 X |
| 5,999,784 | A | 12/1999 | Tsukida et al. | 399/297 |
| 6,016,418 | A | 1/2000 | Kabeya et al. | 399/314 |
| 6,125,247 | A | 9/2000 | Tsukida et al. | 399/66 |
| 6,131,010 | A | 10/2000 | Kume et al. | 399/333 |
| 6,330,407 | B1 | 12/2001 | Tsukida et al. | 399/66 |
| 6,339,441 | B2 | 1/2002 | Suzuki | 347/133 |
| 6,564,021 | B1 | 5/2003 | Nakai et al. | 399/49 |
| 6,654,571 | B2 | 11/2003 | Nanataki et al. | 399/69 |
| 6,804,480 | B2 * | 10/2004 | Otomo | 399/55 |
| 7,021,753 | B2 | 4/2006 | Sano et al. | 347/102 |
| 7,062,184 | B2 * | 6/2006 | Ohtani et al. | 399/45 |
| 2002/0131785 | A1 * | 9/2002 | Ito | 399/44 |
| 2008/0298826 | A1 * | 12/2008 | Yonekubo | 399/44 |

FOREIGN PATENT DOCUMENTS

| | | |
|---|---|---|
| JP | 2002-258550 | 9/2002 |
| JP | 2005-300745 | 10/2005 |
| JP | 2009-009095 A * | 1/2009 |

* cited by examiner

*Primary Examiner* — Sophia S Chen
(74) *Attorney, Agent, or Firm* — Fitzpatrick, Cella, Harper & Scinto

(57) ABSTRACT

An image forming apparatus which predicts VL fluctuations of a photosensitive drum in consideration of a double-sided print mode, and performs an image formation control based on the prediction, and thus always obtains a stable density image. The image forming apparatus performs an appropriate image formation control by controlling an image forming condition based on a photosensitive member rotation time, a photosensitive member stop time, a temperature of an atmospheric environment, an absolute humidity of the atmospheric environment, and whether an image formation that precedes a subsequent image formation is performed in single-sided printing or double-sided printing.

16 Claims, 11 Drawing Sheets

FIG. 7A
TABLE A
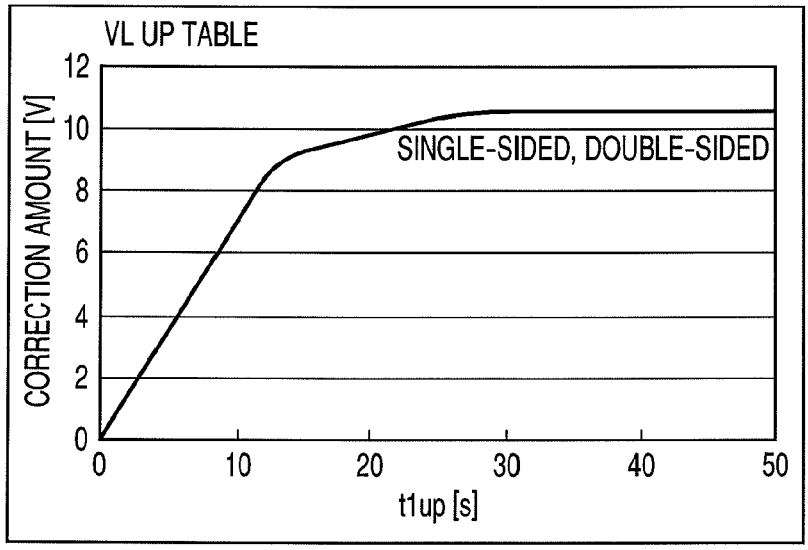
FIG. 7B
TABLE B
| (Vup SIDE) | | ABSOLUTE HUMIDITY: W (g/m³) | | | |
|---|---|---|---|---|---|
| | | 0~2.0 | 2.1~4.0 | 4.1~6.0 | 6.1~ |
| TEMPERATURE: Tc (°C) | 0°C~13°C | 1.5 | 0 | 0 | 0 |
| | 14°C~20°C | 1 | 0 | 0 | 0 |
| | 21°C~26°C | 0.6 | 0 | 0 | 0 |
| | 27°C~ | 0 | 0 | 0 | 0 |
FIG. 7C
TABLE C
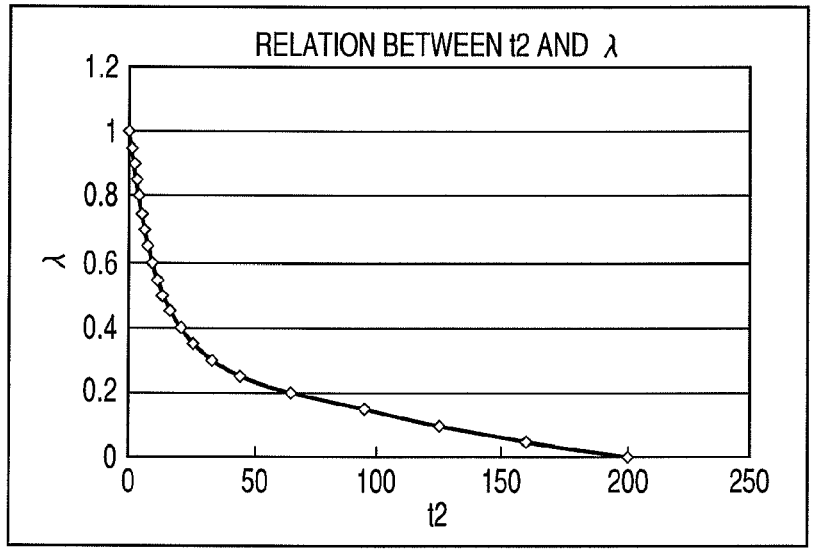

FIG. 8A
TABLE D
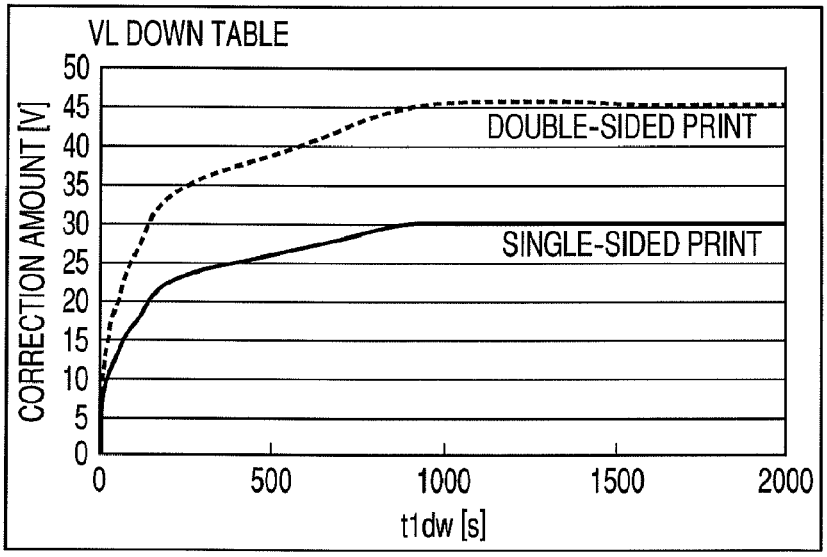
FIG. 8B
TABLE E
| (Vdw SIDE) | | ABSOLUTE HUMIDITY: W (g/m³) | | | |
|---|---|---|---|---|---|
| | | 0~2.0 | 2.1~4.0 | 4.1~6.0 | 6.1~ |
| TEMPERATURE: Tc (°C) | 0°C~13°C | 1.5 | 0 | 0 | 0 |
| | 14°C~20°C | 1 | 0 | 0 | 0 |
| | 21°C~26°C | 0.6 | 0 | 0 | 0 |
| | 27°C~ | 0 | 0 | 0 | 0 |
FIG. 8C
TABLE F
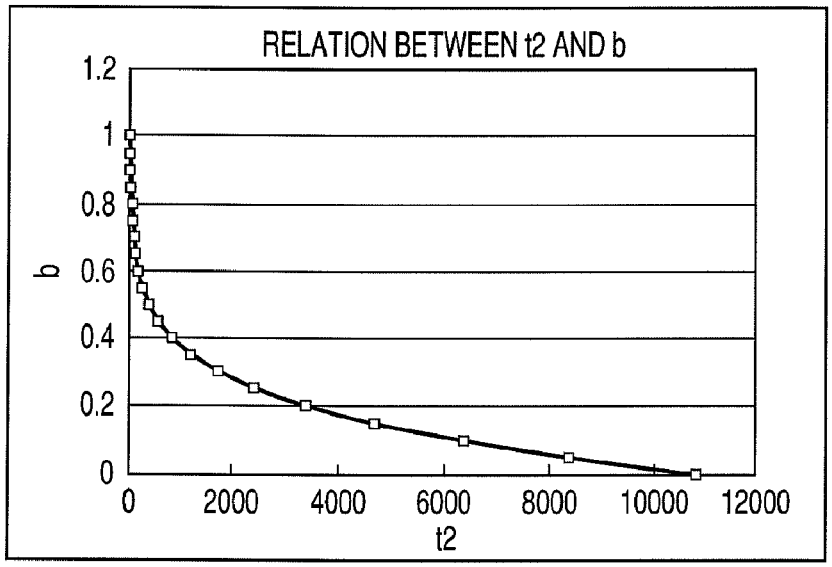

| FIG. 9A |
| --- |
| FIG. 9B |

IMAGE FORMING APPARATUS WITH CONTROL OF IMAGE FORMING CONDITION

BACKGROUND OF THE INVENTION

1. Field of the Invention

The present invention relates to an electrophotographic image forming apparatus such as a copier, a printer, or a facsimile machine.

2. Description of the Related Art

In general, an image forming apparatus that utilizes electrophotography has: a photosensitive member which serves as an image bearing member; a charging device (e.g., corona charger or charging roller) which charges a surface of the photosensitive member; an image exposure device for forming an electrostatic latent image on the photosensitive member; a developing device for developing the electrostatic latent image; a transfer device for transferring a toner image to a transfer material; a cleaning device which cleans residual toner off the photosensitive member; a residual charge eliminating exposure device for eliminating the electrostatic latent image on the photosensitive member; and a fixing device for fixing the toner image on the transfer material.

In the conventional image forming apparatuses utilizing electrophotography, the photosensitive member which holds toner on an electrostatic latent image generally has a photoconductive layer that includes a charge generation layer and a charge transport layer.

The photosensitive member moves by being driven in a given direction in response to a "start of printing" signal.

The charging device applies a bias to the photosensitive member to charge the surface of the photosensitive member to a given electric potential (hereinafter referred to as a charging step).

The surface potential at this stage is called a VD potential. The surface of the photosensitive member is then irradiated with laser light or LED light which is controlled to be turned on/off based on a signal from a controller (hereinafter referred to as an exposure step). A spot on the photosensitive member that is irradiated with light is reduced in electric potential, and thus an electrostatic latent image is formed on the surface of the photosensitive member. The electric potential of a spot irradiated with light is called a VL potential.

Subsequently, a developing bias is applied to the developing device, which is placed to face the photosensitive member and which is filled with toner. This shifts the toner charged to a given level onto an electrostatic latent image on the photosensitive member, which is a photosensitive drum or the like, thereby turning the electrostatic latent image into a toner image (hereinafter referred to as a developing step) A developing bias is denoted by Vdev.

Thereafter, a bias having a polarity opposite to that of the toner on the photosensitive member is applied to the transfer member such as a transferring roller placed adjacent to the photosensitive member and moving in the forward direction at approximately the same speed as the photosensitive member. In this state, the transfer material passes between the photosensitive member and the transfer member, with the result that the toner on the photosensitive member is transferred to the transfer material (hereinafter referred to as a transfer step).

The exposure step sometimes generates residual charges in the photosensitive member, causing VL to fluctuate during an image formation. VL fluctuates also due to a friction between the photosensitive member and components with which the photosensitive member is in contact, such as the charging member, the exposure member, and the cleaning member, and due to a rise in temperature that is caused by heat dissipated from the fixing device or other components while the photosensitive member is moving. In other words, the exposure and moving of the photosensitive member in the process of forming an image causes the fluctuation of the development contrast, which corresponds to the difference between Vdev and VL. The fluctuation leads to variations in how much toner the photosensitive member holds (toner bearing amount) and invites fluctuations in image density on the transfer material. The development contrast is denoted by Vcont.

An image forming apparatus has been proposed which stabilizes image density by detecting VL of the photosensitive member with a sensor and by controlling image forming conditions according to results of the detection (U.S. Pat. No. 6,339,441). A problem of this image forming apparatus is an increase in cost and apparatus size due to the installation of the sensor and a space for installing the sensor.

Another image forming apparatus reduces fluctuations in image density when forming the same image on multiple sheets by selecting an appropriate number of revolutions of the photosensitive member with the charge elimination step and the charging step prior to the formation of an electrostatic latent image in accordance with the temperature and humidity in the vicinity of the photosensitive member (Japanese Patent Application Laid-Open No. 2005-300745). However, increasing the number of revolutions of the photosensitive member before latent image formation is a problem because it slows down the printing speed and lowers the productivity of the image forming apparatus.

As a solution to the above-mentioned problem, an image forming apparatus has been proposed which predicts VL of the photosensitive member from the temperature around the photosensitive member, the photosensitive member rotation time, and the photosensitive member stop time (how long the photosensitive member remains still without rotating), and by executing process control based on the predicted VL (Japanese Patent Application Laid-Open No. 2002-258550).

A study conducted by the inventors of the present invention has confirmed that VL fluctuations in the process of image formation are dependent on the absolute humidity of the atmosphere and that VL fluctuations include a drop in absolute value of VL as well as a rise in absolute value of VL. Therefore, VL fluctuations cannot be predicted accurately with the conventional art proposed in Japanese Patent Application Laid-Open No. 2002-258550, where the absolute humidity of the atmosphere around the photosensitive member is not taken into consideration, nor the possibility of both a rise in VL and a drop in VL happening with time as the photosensitive member rotation time counts up. This conventional art is accordingly incapable of appropriate image formation control and of obtaining an image of a stable density. Hereinafter, a phenomenon that acts to raise the absolute value of VL with time as the photosensitive member rotation time counts up is referred to as "VL UP" and a phenomenon that acts to lower the absolute value of VL with time as the photosensitive member rotation time counts up is referred to as "VL DOWN".

FIG. 2 is a conceptual diagram of the surface potential of a photosensitive member. As illustrated in FIG. 2, the difference between Vdev and VL, "Vdev−VL", corresponds to Vcont. A larger Vcont means more toner to be developed on the photosensitive member and an accordingly higher image density. VL UP is a phenomenon where VL shifts in a direction indicated by an arrow D of FIG. 2 (direction in which the absolute value rises), thereby reducing Vcont and lowering the image density. VL DOWN, on the other hand, is a phenomenon where VL shifts in a direction indicated by an arrow B of FIG. 2 (direction in which the absolute value falls), thereby increasing Vcont and raising the image density.

VL UP and VL DOWN will be described below in detail.

Phenomena relevant to VL UP will be described first. In an L/L environment (low temperature-low humidity environment), for example, an environment where the temperature and the humidity are 15° C./10% RH, a continuous image formation even if only for several sheets causes the VL UP due to the image formation as illustrated in FIG. 3A. A study conducted by the inventors of the present invention has confirmed that the rate of increase in VL per unit time in the VL UP phenomenon is greater in an environment where the absolute humidity is lower.

VL UP is influenced by how long the photosensitive member has remained still before image formation. As a photosensitive member stop time is longer, an amount of increase in VL becomes larger. For instance, VL rises to V1 as illustrated in FIG. 3A when the photosensitive member stop time is long whereas, when the photosensitive member stop time is short, VL rises only to V2, which is smaller than V1, as illustrated in FIG. 3B.

The inventors of the present invention believe that the main cause of the VL UP phenomenon is an increase in number of residual charges in the photoconductive layer due to the exposure of the photosensitive member during image formation. To elaborate, the inventors believe that the cause of VL UP in an environment where the absolute humidity is low is an increased resistance of one of layers in the photoconductive layer which inhibits smooth movement and injection of electric charges. Forming an image in an environment where the absolute humidity is low thus causes residual charges to accumulate in a high resistance layer and results in VL UP. One way to predict the amount of VL UP is to estimate a time for image formation on the basis of the photosensitive member rotation time.

Residual charges generated in the process of forming an image gradually leave from the photoconductive layer to the ground after the image formation is completed and stopped. As the image formation stop time is longer, residual charges generated in the previous image formation becomes less so that the photosensitive layer falls into a state in which residual charges are prone to accumulate in the subsequent image formation. Therefore, as an image formation stop time is longer, influence of VL UP becomes more conspicuous and an amount of increase in VL becomes larger in the subsequent image formation.

The VL DOWN phenomenon will be described below. When a continuous image formation is performed, VL drops with time as the photosensitive member rotation time counts up as illustrated in FIG. 3C.

VL lowered by VL DOWN exhibited a tendency to return to a level closer to the original VL level when a period of time without any image formation after an image formation, namely, the photosensitive member stop time, is longer. For instance, in the case where VL DOWN due to the precedent image formation lowers VL in the precedent image formation to V4 as illustrated in FIG. 3C, the initial VL in the subsequent image formation took a value closer to V3, which is the original VL level, as the photosensitive member stop time is longer as illustrated in FIG. 3D.

The inventors of the present invention believe that the main cause of VL DOWN is a decrease in number of residual charges in the photoconductive layer. To elaborate, forming an image raises the temperature of the photosensitive member, thereby lowering the resistance of the photoconductive layer, and thus the inventors of the present invention believe that the cause of VL DOWN is the lowered photoconductive layer resistance which allows residual charges trapped in the photoconductive layer to exit the photosensitive member. VL DOWN thus takes place when the temperature of the photosensitive member rises with time as the photosensitive member rotation time counts up, which lowers the resistance of the photoconductive layer and reduces trapped residual charges. Factors that raise the temperature of the photosensitive member with time as the photosensitive member rotation time counts up are a friction with members that are in contact with the photosensitive member, such as the developing member, the charging member, and the cleaning member, and heat dissipation from the fixing device and other components.

Depending on the temperature and humidity of an atmospheric environment where the image forming apparatus is set, one or both of VL UP and VL DOWN may take place. In one environment, VL rises once and then drops as illustrated in FIG. 3E. In a different environment, VL falls once and then rises as illustrated in FIG. 3F.

As described above, VL fluctuations have absolute humidity-related factors in addition to temperature-related factors such as the temperature of an environment in which the image forming apparatus is set, the temperature inside the image forming apparatus, or the temperature around or of the photosensitive member itself. Appropriate image formation control and an image of a stable density therefore cannot be obtained with the conventional art proposed in Japanese Patent Application Laid-Open No. 2002-258550 which does not include predicting VL fluctuations that may or may not occur depending on the absolute humidity.

Also, in the conventional art proposed in Japanese Patent Application Laid-Open No. 2002-258550, an image formation is controlled on the premise that only one of VL UP and VL DOWN takes place. Therefore, there is a problem in that, when VL UP and VL DOWN occur simultaneously, an appropriate image formation control is not accomplished so that an image of a stable density cannot be obtained.

According to a study conducted by the inventors of the present invention, the amount of VL DOWN is larger in a double-sided print mode than in a single-sided print mode. This is because, in the double-sided print mode where the transfer step is performed again on a transfer material that has already passed through the fixing device and been heated once, the heat of the transfer material is transmitted directly or indirectly to the photosensitive member, which can cause the temperature of the photosensitive member to rise to a higher level than in the single-sided print mode.

An image forming apparatus that applies to the case where the heat of a transfer material is transmitted directly to the photosensitive member is one in which a transfer material is brought into direct contact with a photosensitive drum, whereby a toner image on the photosensitive drum is transferred to the transfer material. An image forming apparatus that applies to the case where the heat of a transfer material is transmitted indirectly to the photosensitive member is one in which a toner image on a photosensitive drum is transferred first to an intermediate transfer member and then toner images on the intermediate transfer member are transferred to the transfer material at once.

An image of a stable density cannot be obtained in the double-sided print mode with the conventional art proposed in Japanese Patent Application Laid-Open No. 2002-258550, where the difference in VL potential fluctuation between double-sided printing and single-sided printing is not taken into consideration.

SUMMARY OF THE INVENTION

The present invention has been made with solving the above-mentioned problems of the conventional art as a starting point. An object of the present invention is therefore to appropriately control image forming conditions in accordance with a print mode of a recording material.

Further features of the present invention become apparent from the following description of exemplary embodiments with reference to the attached drawings.

BRIEF DESCRIPTION OF THE DRAWINGS

FIGS. 7A, 7B, and 7C are diagrams illustrating the contents of a VL UP table according to the present invention.

FIGS. 8A, 8B, and 8C are diagrams illustrating the contents of a VL DOWN table according to the present invention.

DESCRIPTION OF THE EMBODIMENT

An embodiment of the present invention will be described below with reference to the drawings.

First Embodiment

Figure 4:
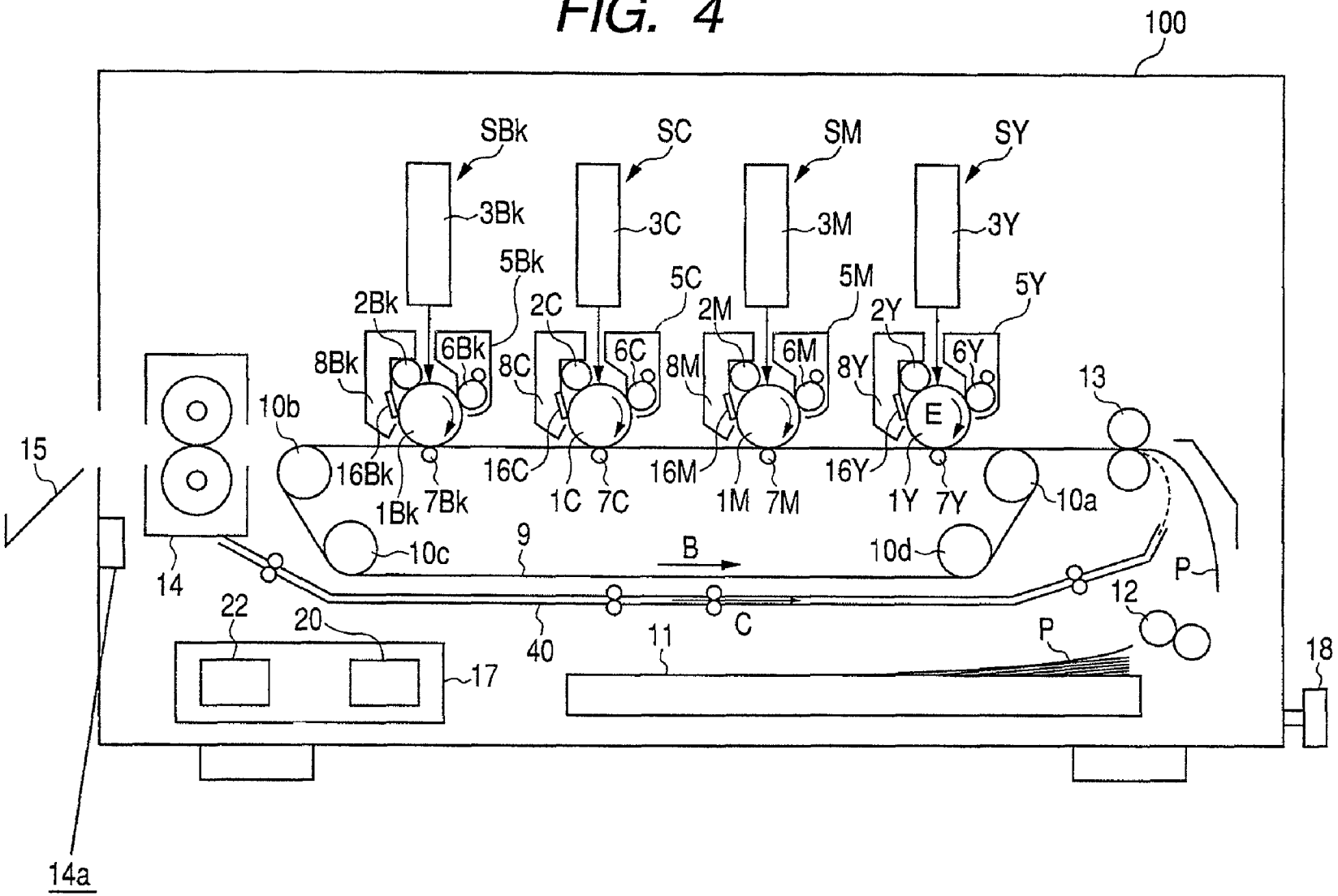
FIG. 4 is a diagram illustrating a structure of an image forming apparatus according to the present invention.

FIG. 4 illustrates a schematic structure of an image forming apparatus of this embodiment. An image forming apparatus 100 of this embodiment is a laser beam printer which forms an image through an electrophotographic image formation process on a recording medium (transfer material) such as recording paper, an OHP sheet, or cloth.

The image forming apparatus 100 of this embodiment has cylindrical photosensitive drums 1 each serving as an image bearing member and is supported in a manner that allows the photosensitive drum 1 to rotate about its axis in a direction indicated by an arrow E of FIG. 4. When image formation operation is started, a surface of a rotating photosensitive drum 1Y is uniformly charged to a negative potential by roller-shaped charging means (charging roller) 2Y. Thereafter, an exposure device 3Y which is exposure means scans and exposes the surface of the photosensitive drum 1Y using light based on image information, to thereby form an electrostatic latent image on the surface of the photosensitive drum 1Y. The latent image formed on the photosensitive drum 1Y is developed when a developing device 5Y supplies yellow toner (hereinafter referred to as Y toner).

The developing device 5Y applies a developing bias to a developing sleeve 6Y, whereby the latent image written on the photosensitive drum 1Y is formed as a Y toner layer. The Y toner layer is transferred, when a transferring bias voltage is applied to a transfer roller 7Y, to a surface of a transfer material P on a transfer belt 9 which is fed from a sheet feeding cassette 11 via a sheet feeding roller 12. Toner remaining on the surface of the photosensitive drum 1Y without being transferred to the transfer material P is removed by a cleaning blade 16Y and then contained in an waste toner container 8Y.

The transfer belt 9 is stretched over four rollers 10*a*, 10*b*, 10*c*, and 10*d*, and rotates in a direction indicated by an arrow B of FIG. 4 to carry the transfer material P on its surface and transport the transfer material P to image formation stations SY, SM, SC, and SBk sequentially.

The above-mentioned processing is performed also in the stations for other colors, namely, the stations SM (magenta), SC (cyan), and SBk (black), thereby forming a toner image (developer image) which is formed of superimposed toner layers of different colors on the transfer material P. Past the roller 10*b* placed on a downstream side of the transfer belt 9, a fixing device 14, which is placed further downstream of roller 10*b*, melts and fixes the toner image transferred to the surface of the transfer material P. The transfer material P is then delivered onto a tray 15 which is placed outside the color image forming apparatus 100. Incidentally, the structures of the stations for respective numerals designate the structures of the stations for respective colors. The station for each color comprises: a photosensitive drum 1Y, 1M, 1C, 1BK; charging means (a charging roller) 2Y, 2M, 2C, 2BK; an exposure device 3Y, 3M, 3C, 3BK; a developing device 5Y, 5M, 5C, 5BK; a developing sleeve 6Y, 6M, YC, 6BK; a transfer roller 7Y, 7M, 7C, 7BK; a waste toner containing portion 8Y, 8M, 8C, 8BK; and a cleaning blade 16Y, 16M, 16C, 16BK.

In double-sided printing, the transfer material P passes through the fixing device 14 and then travels along a double-sided sheet transport path 40 in a direction indicated by an arrow C, to thereby flip the transfer material P over to the opposite printing side. The transfer material P flipped over to the opposite printing side is again transported to the image formation stations SY to SBk sequentially, and toner layers of respective colors are superimposed to form a toner image. Thereafter, the transfer material P again passes through the fixing device 14, where the toner image is melted and fixed, and printed images are thus obtained on both sides of the transfer material P. As described above, in the double-sided print mode where the transfer step is performed again on a transfer material that has already passed through the fixing device and been heated once, the heat of the transfer material is transmitted directly or indirectly to the photosensitive member, which makes the temperature of the photosensitive member more amenable to rise higher than in the single-sided print mode. The amount of VL DOWN described later can therefore be larger in the double-sided print mode than in the single-sided print mode.

The image forming apparatus 100 is provided with a temperature and humidity sensor 18 as temperature and humidity detecting means, which detects an atmospheric environment in which the image forming apparatus 100 is used. The detected temperature and humidity are output to a CPU 22. The CPU 22 uses the temperature and relative humidity inputted by the temperature and humidity sensor 18 to calculate the absolute humidity of the atmospheric environment, and stores information on the temperature of the atmospheric environment and information on the absolute humidity of the atmospheric environment in storing means 20 in one-tenths of a degree Celsius (on a 0.1° C. basis) and in one-tenths of a gram per cubic meter (on a 0.1 g/$m^3$ basis), respectively. The absolute humidity refers to the amount (g) of water vapor contained per unit volume of the atmospheric environment, and is measured in g/m$^3$. Where to install the temperature and humidity sensor 18 is not limited to the place illustrated in FIG. 4, and the temperature and humidity sensor 18 may be installed around the photosensitive drums 1 or in other places. The temperature detected by the temperature and humidity sensor 18 does not equal the actual temperature of the photosensitive drums 1 even when the temperature and humidity sensor 18 is placed around the photosensitive drums 1. Accordingly, switching developing biases based solely on temperature and humidity information of the temperature and humidity sensor 18 that is placed around the photosensitive drums 1 does not stabilize image density with respect to the photosensitive drum rotation time. It is therefore desirable to control based on a prediction that takes into account the rotation time and stop time of the photosensitive drums 1 in addition to detection results of the temperature and humidity sensor 18 as the ones described in this embodiment.

Information on the temperature of the atmospheric environment and information on the absolute humidity of the atmospheric environment, which are, in this embodiment, stored in the storing means 20 on a 0.1° C. basis and on a 0.1 g/m$^3$ basis, respectively. However, the present invention is not limited thereto, and other basis may be used. While this embodiment uses the absolute humidity that is calculated from the temperature and the relative humidity, the absolute humidity that is measured directly may be used if it is possible.

Mono-component development is employed in this embodiment, but dual-component development may be employed instead. Developing means in the present invention may be one that uses a magnetic developer or one that uses a non-magnetic developer, and is not particularly limited. The present invention can employ any known developer that is used in electrophotography, and a developer optimum for the developing means is selected. The developer used in this embodiment is a non-magnetic developer.

The photosensitive drums 1 of the image forming apparatus 100 will be described below. The photoconductive layer of each photosensitive drum 1 is a laminate of layers having different functions: a charge generation layer which contains a charge generating substance, and a charge transport layer which contains a charge transporting substance. A surface layer is formed as a protective layer on the laminate photoconductive layer.

Figure 5:
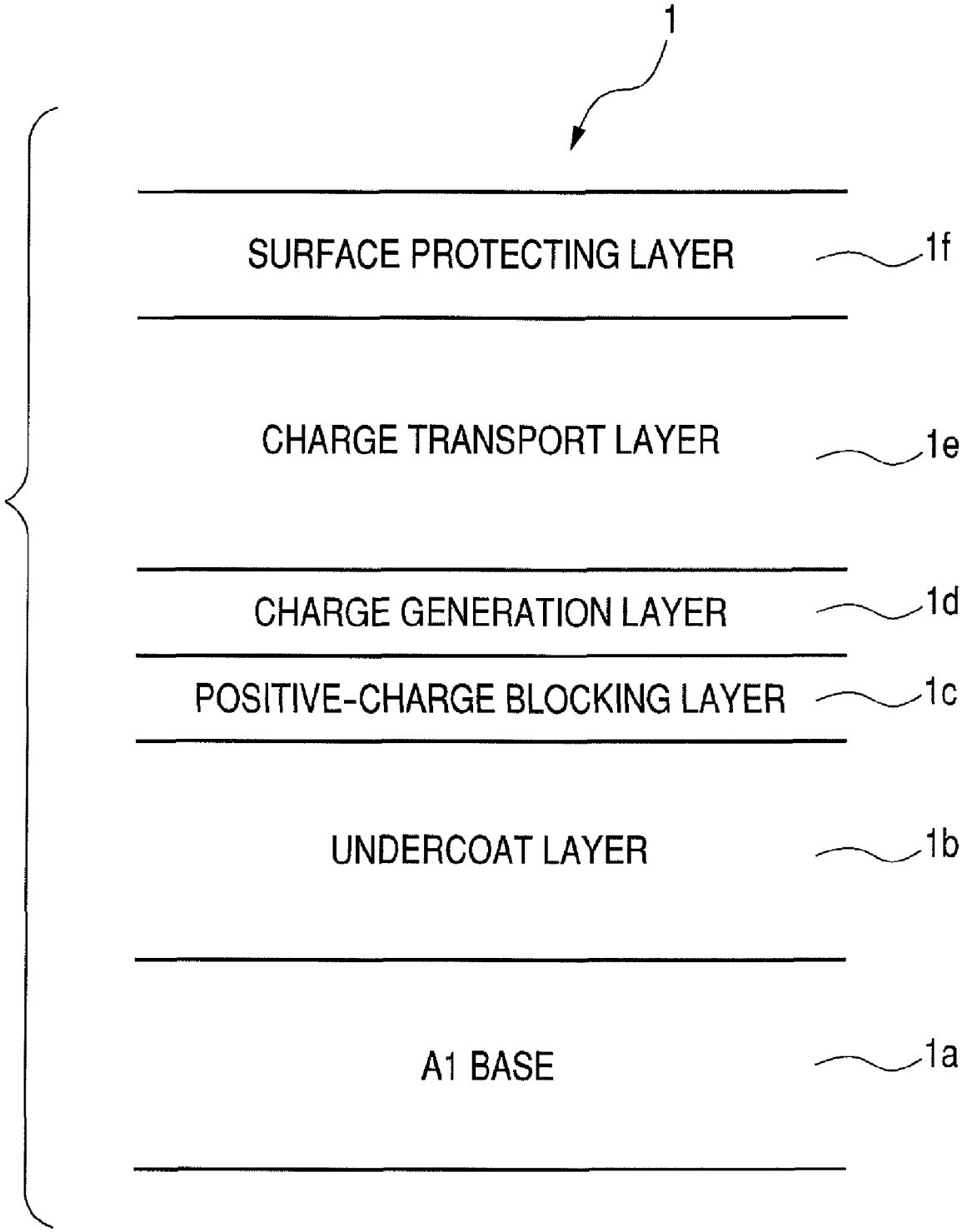
FIG. 5 is a sectional view of a photosensitive drum according to the present invention.

The layer structure of the photoconductive layer of each photosensitive drum 1 will be described with reference to FIG. 5.

An undercoat layer 1*b* which has a barrier function and a bonding function is provided on an Al base 1*a* which is conductive and serves as a support member of the photosensitive member. Provided on the undercoat layer 1*b* is a positive-charge blocking layer 1*c* which has a medium resistance and a function to prevent positive charges injected from the aluminum base 1*a* from canceling out negative charges with which the surface of the photosensitive drum 1 is charged.

A charge generation layer 1*d* containing a charge generating substance is provided on the positive-charge blocking layer 1*c*. The charge generation layer 1*d* is formed by applying a coating liquid for charge generation layer, which is obtained by dispersing a charge generating substance along with a binder resin and a solvent, and by drying the applied liquid.

A charge transport layer 1*e* containing a charge transporting substance is provided on the charge generation layer 1*d*. The charge transport layer 1*e* is formed by applying a coating liquid for charge transport layer, which is obtained by dissolving a charge transporting substance and binder resin in a solvent, and drying the applied liquid.

A surface protecting layer 1*f* is provided as a surface layer on the charge transport layer 1*e*. The surface protecting layer 1*f* is a cured layer formed by applying a coating liquid that is curable phenol resin dissolved in or diluted with a solvent on the photoconductive layer, and by letting a polymerization reaction happen after the application.

The description will be provided of a method of controlling the image density of the image forming apparatus 100 in this embodiment.

Part of the image density control is keeping the maximum density of each color constant (hereinafter referred to as Dmax control), and keeping the half tone gradation characteristics linear with respect to image signals (hereinafter referred to as Dhalf control).

In Dmax control, the maximum density of each color is influenced by the film thickness of the photosensitive drum 1 and the atmospheric environment, and hence image forming conditions including the charging bias and the developing bias are set on the basis of results of detecting the environment and CRG tag information so that a desired maximum density is obtained.

In Dhalf control, non-linear input-output characteristics (Y characteristics) unique to electrophotography are prevented from causing a gap between an input image signal and an output density and thereby hindering the formation of a natural image. This is accomplished by performing such image processing that negates the γ characteristics and keeps the input-output characteristics linear. An optical sensor is used to detect multiple toner patches associated with different input image signals, and to obtain the relation between input image signals and the density. The obtained relation is used to convert an image signal to be input to the image forming apparatus in a manner that ensures that the input image signal produces a desired density. Dhalf control is performed after image forming conditions including the charging bias and the developing bias are determined in Dmax control.

When VL fluctuations cause the density of an output image to change with time as the photosensitive member rotation time counts up, fluctuations in hue can be reduced by performing Dmax control and Dhalf control frequently, for example, for every five sheets printed. However, frequent Dmax control and Dhalf control are not practical because the printing speed is greatly reduced and the productivity of the image forming apparatus is lowered markedly. In this embodiment, Dmax control and Dhalf control are therefore performed only once for every 1,000 sheets printed. The schedule of performing Dmax control and Dhalf control is not limited to one in this embodiment, namely, once for every 1000 sheets printed, but Dmax control and Dhalf control can be performed on a different schedule. The image forming apparatus may be structured so that Dhalf control is not performed even once. In addition, when to perform Dmax control and Dhalf control may be determined based on other parameters than the number of sheets printed, for example, the amount of toner consumed.

In this embodiment where Dmax control and Dhalf control are performed once for every 1,000 sheets printed, VL fluctuates greatly during a period between the last time Dmax control and Dhalf control are performed and the next time. Accordingly, controlling the image density through Dmax control and Dhalf control alone does not yield a stable image density. This embodiment therefore employs other image density control methods than Dmax control and Dhalf control. Specifically, image formation control successively corrects the charging bias or the developing bias (Vdev), which is determined through Dmax control by predicting VL fluctuations based on the photosensitive member rotation time, the photosensitive member stop time, and the temperature and humidity, in a manner that keeps the development contrast (Vcont) constant.

Figure 1:
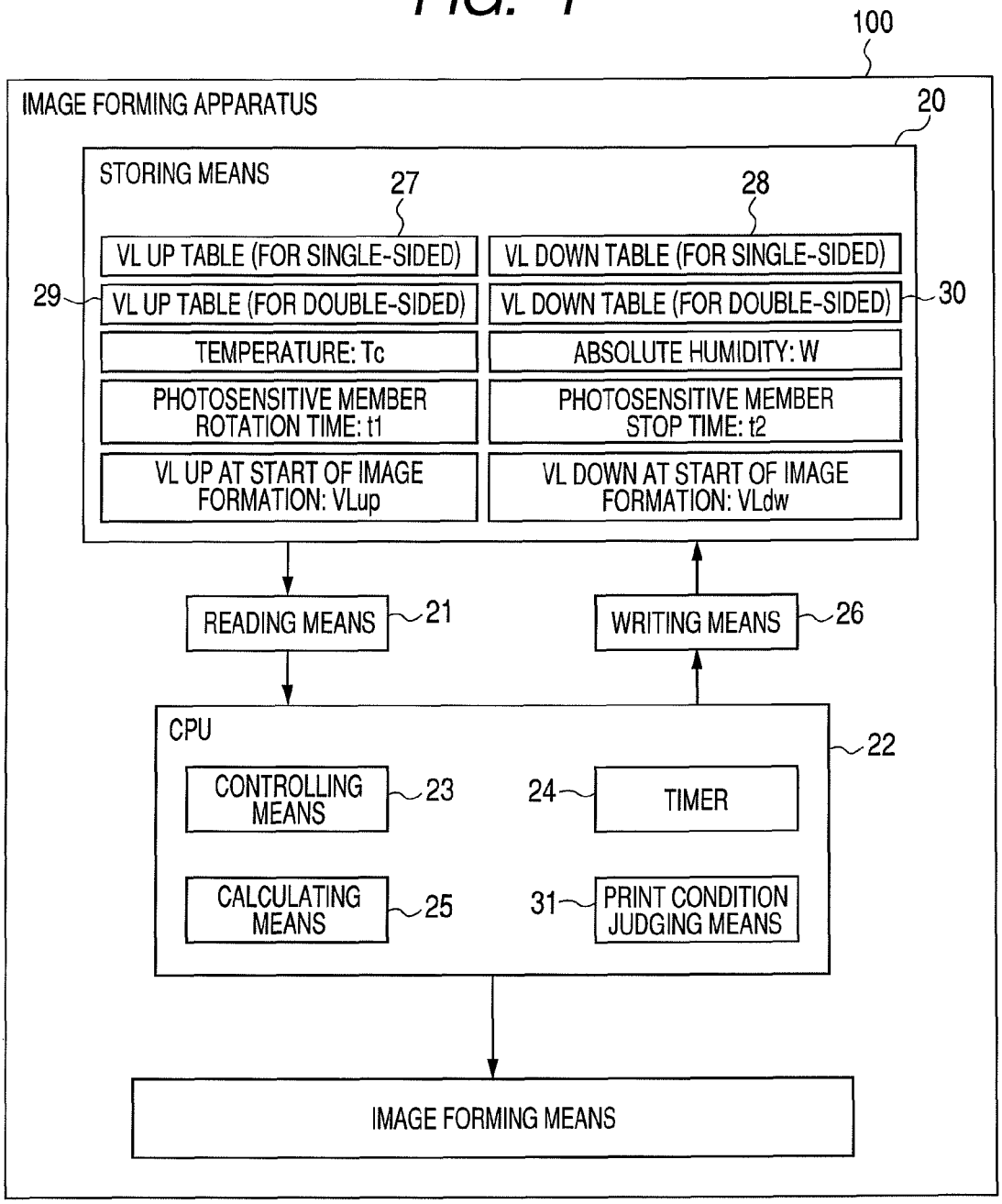
FIG. 1 is a block diagram of a system according to the present invention.
Figure 2:
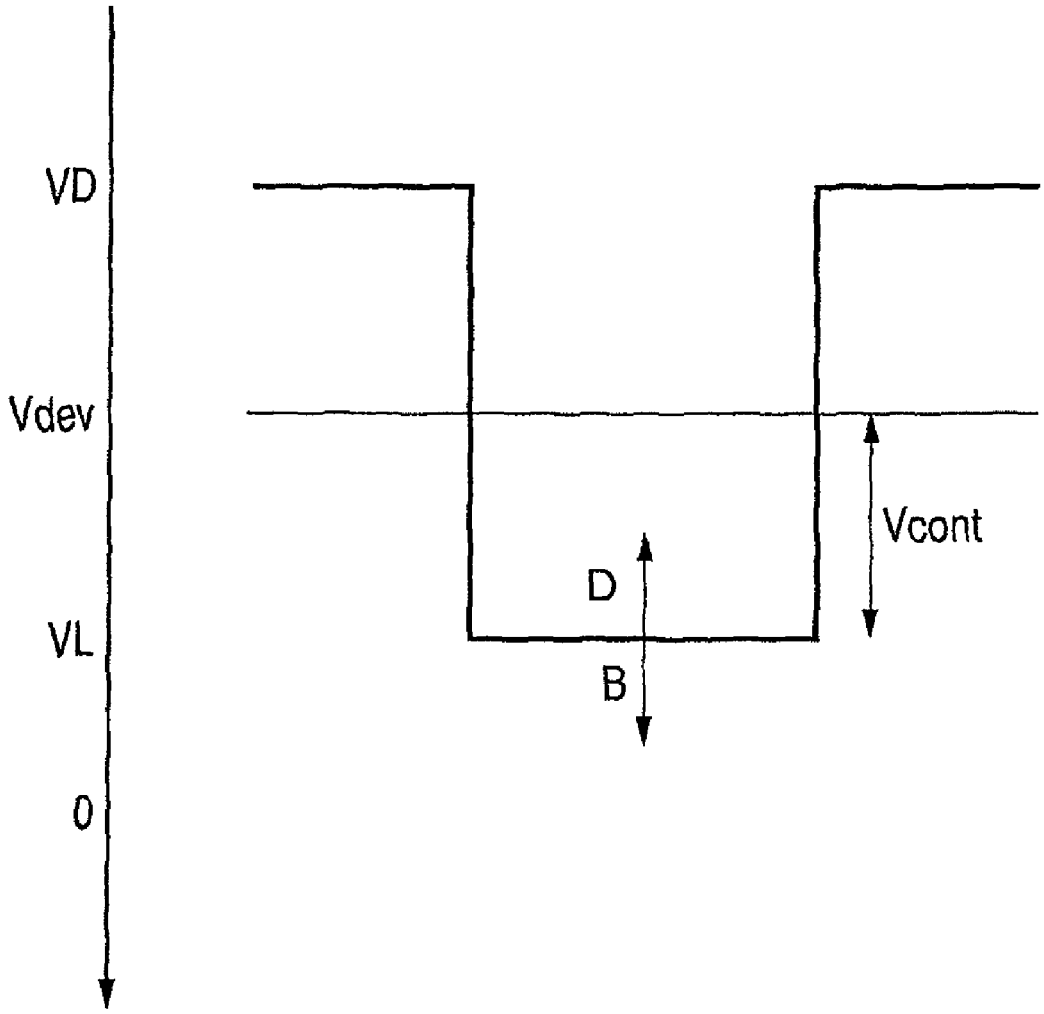
FIG. 2 is a diagram illustrating a concept of a surface potential of a photosensitive member.
Figure 3A:
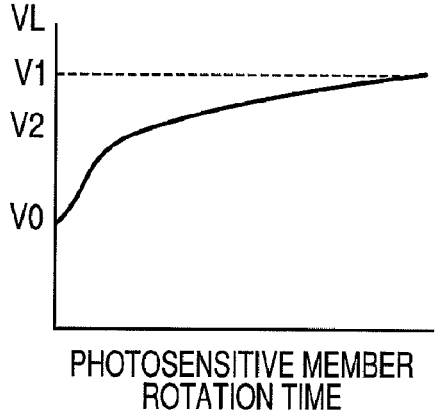
FIGS. 3A, 3B, 3C, 3D, 3E, and 3F are graphs illustrating a relation between a photosensitive drum rotation time and the surface potential of a photosensitive drum.
Figure 3B:
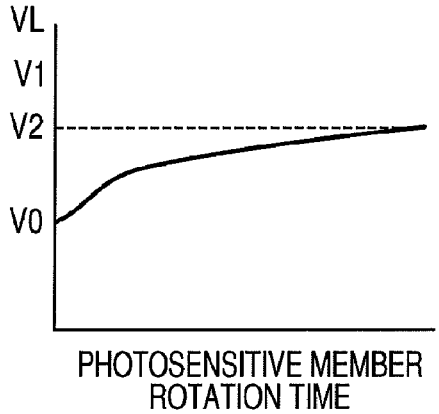
Figure 3C:
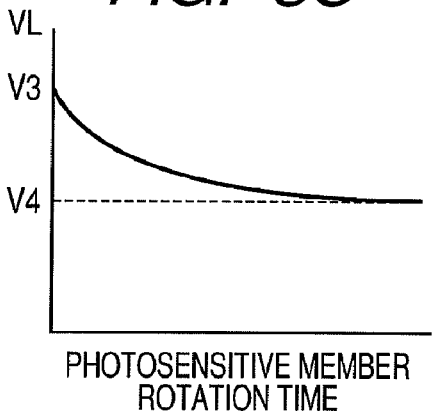
Figure 3D:
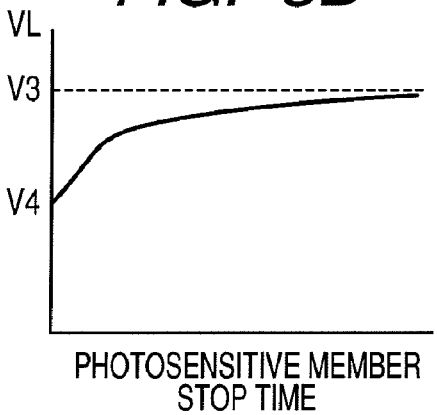
Figure 3E:
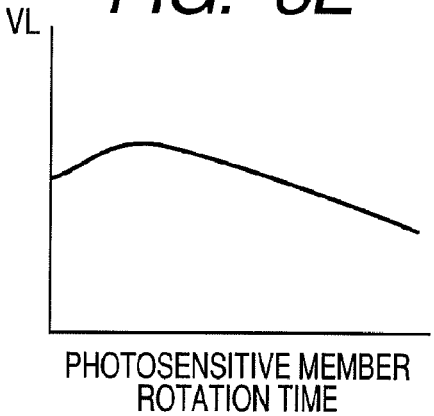
Figure 3F:
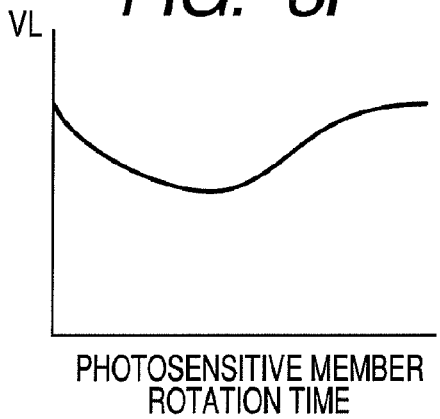

FIG. 1 is a block diagram of a system for image formation control in this embodiment. The storing means 20, the CPU 22, reading means 21, and writing means 26 are provided in an engine control unit 17 of the image forming apparatus 100 as illustrated in FIG. 4. The storing means 20 can be, but not limited to, a known electronic memory. The storing means 20 in this embodiment is a non-volatile EEPROM.

The CPU 22 includes: calculating means 25 which predicts VL fluctuations; controlling means 23 which controls image forming conditions based on a result of a VL fluctuation prediction made by the calculating means 25; a timer 24 which is time measuring means capable of measuring the photosensitive member rotation time and the photosensitive member stop time; and print condition judging means 31 which determines whether the current print mode is a double-sided print mode or a single-sided print mode.

The single-sided print mode is a mode in which the image forming apparatus 100 performs printing only on transfer materials P that have never passed through the fixing device 14. The double-sided print mode is a mode in which the image forming apparatus 100 performs printing alternately on the transfer material P that has passed through the fixing device 14 once and the transfer material P that has never passed through the fixing device 14.

The timer 24 counts the photosensitive member rotation time on the second time scale while the photosensitive drum 1 is being driven, and counts the photosensitive member stop time on the second time scale while the driving of the photosensitive drum 1 is stopped. The timer 24, which counts on the second time scale in this embodiment, may count on other basis than on the second time scale. The photosensitive member rotation time and the photosensitive member stop time measured by the timer 24 are stored in the storing means 20 via the writing means 26. While this embodiment uses the timer 24 to count the photosensitive member rotation time and the photosensitive member stop time both, two timers may be used to measure the photosensitive member rotation time and the photosensitive member stop time independently.

The image forming apparatus 100 is provided with the reading means 21 which reads information stored in the storing means 20. The reading means 21 sends information read out of the storing means 20 to the CPU 22. The read information is used by the calculating means 25 within the CPU 22 to predict VL fluctuations by a method described later. Based on the prediction made by the calculating means 25, the controlling means 23 sends information for controlling the image formation process to image forming means.

Image formation control in the image forming apparatus 100 of this embodiment will be described below. In order to stabilize image density when VL UP and/or VL DOWN occurs, image formation control is necessary so as to correct fluctuations in VL of the photosensitive drum 1 with respect to the photosensitive member rotation time.

Such image formation control is accomplished by, for example, controlling the developing bias or controlling the charging bias as described above. To give an example, in the case where VL DOWN occurs, the calculating means calculates a correction amount (first correction amount) that acts to increase the absolute value of the charging bias by an amount lost due to VL DOWN. In the case where VL UP occurs, the calculating means calculates a correction amount (second correction amount) that acts to reduce the absolute value of the charging bias by an amount added due to VL UP. To give another example, in the case where VL DOWN occurs, the calculating means calculates a correction amount (third correction amount) that acts to reduce the absolute value of the developing bias by an amount of VL DOWN. In the case where VL UP occurs, the calculating means calculates a correction amount (fourth correction amount) that acts to increase the absolute value of the developing bias by an amount of VL UP. The description of this embodiment takes as an example a case of controlling the developing bias of the developing device 5.

Figure 6:
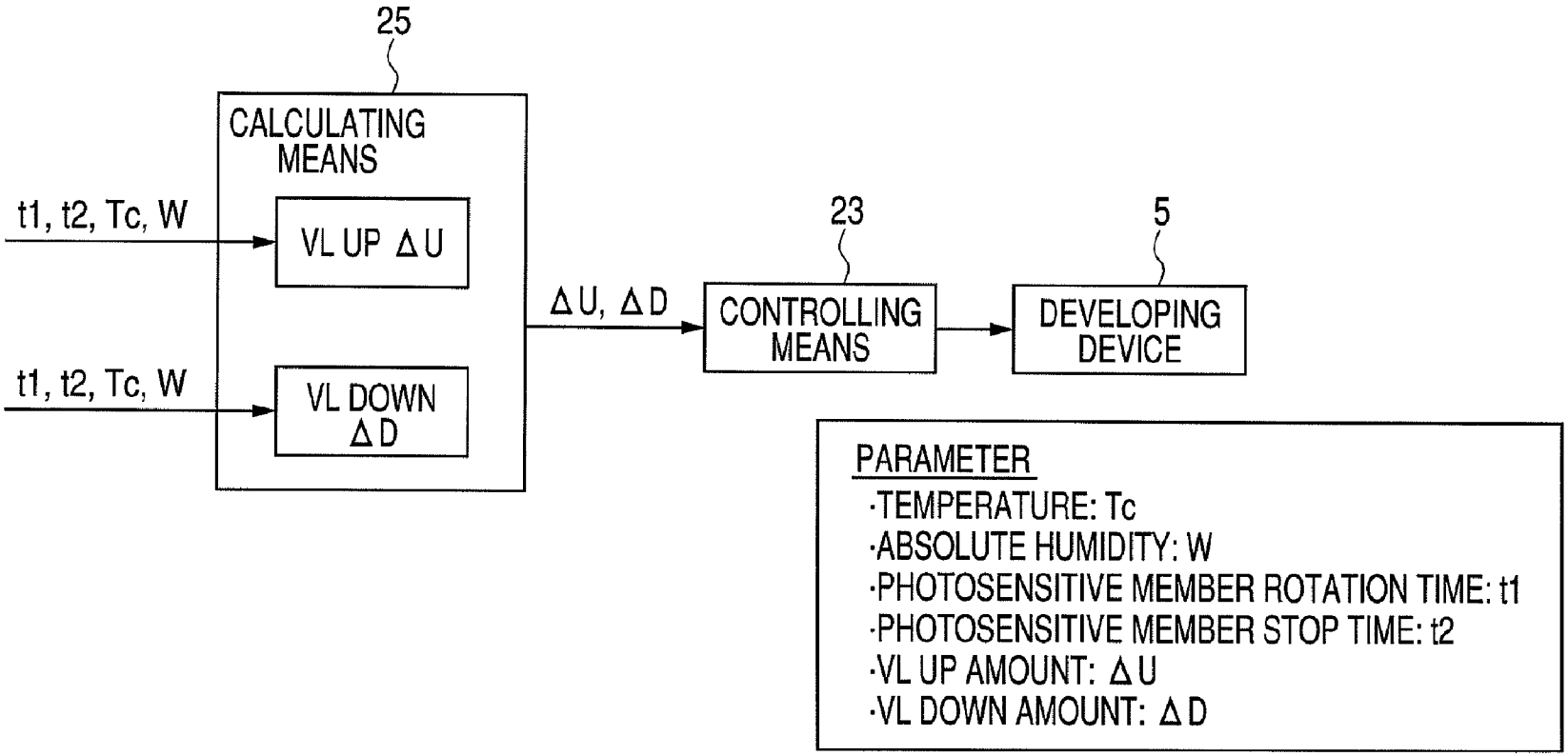
FIG. 6 is a conceptual diagram of process control according to the present invention.

FIG. 6 is a conceptual diagram of image formation control according to this embodiment. In this embodiment, the calculating means 25 calculates ΔU, which represents the amount of fluctuations due to VL UP, based on four parameters t1, t2, W, and Tc, and calculates ΔD, which represents the amount of fluctuations due to VL DOWN, based on four parameters t1, t2, W, and Tc. ΔU is 0 or a negative value, whereas ΔD is 0 or a positive value.

Represented by t1 and t2 are the photosensitive drum rotation time and the photosensitive drum stop time, respectively. The environment temperature Tc and the absolute humidity W are values read by the temperature and humidity sensor 18 when the image forming apparatus 100 is powered on, and stored in the storing means 20.

In this embodiment, information is reset with t1 set to 0 at the start of the formation of a single image (one unit of image forming job). The photosensitive member rotation time t1 therefore corresponds to a photosensitive member rotation time counted from the start of the image formation to the execution of image forming condition control by the controlling device. In other words, t1 is information on a photosensitive member rotation time that is the time elapsed since when the photosensitive member in a stop state starts moving. Further, information is reset with t2 set to 0 at the end of the formation of a single image (one unit of image forming job). The photosensitive member stop time t2 therefore corresponds to a photosensitive member rotation stop time counted from the end of the preceding image formation to the start of the succeeding image formation. In other words, t2 is information on a photosensitive member stop time that is the time elapsed since when the photosensitive member in a moving state stops moving.

The calculation of ΔU in this embodiment, details of which will be described later, uses W, Tc, and a substantial photosensitive drum rotation time t1up which is obtained from t1 and t2. Similarly, the calculation of ΔD uses W, Tc, and a substantial photosensitive drum rotation time t1dw which is calculated from t1 and t2.

This embodiment uses a substantial photosensitive member rotation time for VL UP count (hereinafter referred to as t1up) and a substantial photosensitive member rotation time for VL DOWN count (hereinafter referred to as t1dw) as individual parameters. In the following description, t1up and t1dw represent the respective substantial photosensitive member rotation times.

The calculating means 25 predicts how VL fluctuates and, based on the prediction, the controlling means 23 controls the developing bias to be applied to the developing device 5 so that Vcont remains the same.

Predicting VL fluctuations requires predicting fluctuations due to VL UP and fluctuations due to VL DOWN both. The calculating means 25 predicts VL fluctuations by calculating the amount of VL UP fluctuations and the amount of VL DOWN fluctuations separately.

Details of a method employed by the calculating means 25 to calculate fluctuations in VL will be described below. Characteristics related to VL fluctuations are provided by a table stored in the storing means 20, and the calculating means 25 calculates VL fluctuations by referring to the table.

How to calculate VL UP fluctuations and how to calculate VL DOWN fluctuations will be separately described below.

Description will be first provided of a method of calculating VL UP fluctuations. Fluctuations due to VL UP are calculated by referring to a VL UP table 27 for a single-sided print mode and a VL UP table 29 for a double-sided print mode which are stored in the storing means 20 as illustrated in FIG. 1.

The VL UP tables include a table A, a table B, and a table C as illustrated in FIGS. 7A, 7B, and 7C. The amount of VL UP fluctuations with respect to the photosensitive member rotation time is calculated based on those tables. The table A illustrates the amount of VL fluctuations with respect to the photosensitive member rotation time t1up as illustrated in FIG. 7A. The table B illustrates, in a 4×4 matrix, coefficients that are selected based on the temperature Tc and absolute humidity W of the atmospheric environment as illustrated in FIG. 7B.

The table C illustrates coefficients that are selected based on the photosensitive member stop time t2. For example, when t2=200 (S), λ=0. This means that the influence of residual charges contained in the photosensitive drum returns to a level closer to the original level as the photosensitive member stop time becomes longer.

The amount of VL UP fluctuations with respect to the photosensitive member rotation time is calculated by multiplying the amount of the table A by a coefficient selected from the table B. FIG. 7A is a graph and is not in a table format, but the graph is actually kept in a table format in the table A.

As described above, the fluctuation amount ΔU due to the VL UP is calculated from three parameters, t1up (obtained from t1 and t2), W, and Tc. The reason for this will be described as follows.

As can be seen in the table A, the fluctuation amount ΔU is larger as the photosensitive member rotation time t1 becomes longer. For instance, in the table A, the fluctuation amount ΔU is substantially saturated at 10.5 (V) when the photosensitive member rotation time t1 exceeds 30 (s). However, in the case where the photosensitive member has already been rotating for 10 (s) and ΔU has reached 6 at the time when the counting of t1 is started, the fluctuation amount ΔU is saturated at 10.5 V when the photosensitive member rotation time t1 is past 20 (s). Thus, basing the calculation simply on the photosensitive member rotation time t1 does not yield an appropriate ΔU. The calculation of ΔU therefore uses the substantial photosensitive member rotation time t1up in which a state of the photosensitive member at the time when the counting of t1 is started is taken into account.

In this embodiment, the counting of t1 is started after information is reset with t1 set to 0 at the start of one unit of image forming job. This allows for adding the state of the photosensitive member at the start of t1 counting into consideration. Specifically, the state of the VL UP fluctuation amount of the photosensitive member (VLup) is obtained from Vupend and λ. Vupend represents the value of ΔU at the end of an image forming job that immediately precedes the current image forming job. λ represents a correction coefficient obtained from the photosensitive member stop time t2 that is counted from the end of the immediately preceding image forming job to the start of the current image forming job.

VLup is expressed as follows:

$$VLup=\lambda\times Vupend$$

The VLup value is converted into the photosensitive member rotation time t1 with the use of the table A, and the converted value is represented as t1up_lk. The value t1up_lk indicates for how long the photosensitive member has already been rotating at the time when the counting of t1 is started. An appropriate ΔU can be obtained by using the sum of t1up_lk and t1 as the substantial photosensitive member rotation time.

A method of calculating the amount of VL UP observed while the photosensitive drum 1 is being driven will be described. The amount ΔU of fluctuations due to VL UP in the process of image formation is calculated from the photosensitive member rotation time t1up and the table A. The time t1up, which is the substantial rotation time of the photosensitive drum 1 as described above, has a relation expressed by Numerical Expression 1. In other words, t1up is the sum of the time t1 elapsed since when the photosensitive drum 1 starts rotating in the current image forming job and t1up_lk which indicates the state of the photosensitive member at the time when the current image forming job is started.

$$t1up=t1+t1up_lk \qquad \text{Numerical Expression 1}$$

In Numerical Expression 1, t1 represents the time elapsed since when the photosensitive drum 1 starts rotating in the current image forming job, and t1up_lk represents a value obtained through a conversion in which the VL UP amount of the photosensitive member at the time when the current image forming job is started is calculated back into a time with the use of the table A.

The VL UP amount calculated from the table A is multiplied by a coefficient that is selected from the table B of FIG. 7B based on the temperature Tc and absolute humidity W of the atmospheric environment. The VL UP amount ΔU with which the controlling means 23 controls image formation is thus determined.

After the image forming job is ended and the photosensitive drum 1 stops rotating, the calculating means 25 stores Vupend, which is the VL UP amount at the time when the photosensitive drum 1 stops rotating, in the storing means 20, and the timer 24 starts counting the photosensitive member stop time t2. The value of the photosensitive member stop time t2 that is counted from the end of the current image forming job to the start of the subsequent image forming job is used in selecting from the table C of FIG. 7C the coefficient λ by which Vupend is to be multiplied. When the subsequent image forming job is started, VLup is obtained from the stored Vupend and the selected λ by Numerical Expression 2.

$$VLup=\lambda\times Vupend \qquad \text{Numerical Expression 2}$$

VLup which is the VL UP amount of the photosensitive member at the time when the current image forming job is started is expressed by Numerical Expression 2. The value t1up_lk expressed by Numerical Expression 1 is one obtained by a conversion in which the amount VLup is calculated back into a time with the use of the table A.

This embodiment uses the same table A for the single-sided print mode and for the double-sided print mode. Alternatively, different tables may be used for different print modes.

The calculation of t1up_lk in that case is a reverse operation using the table A that has been prepared for the employed print mode. For example, in the case where the previous job is performed in the single-sided print mode and the current job is performed in the double-sided print mode, the VL UP amount is converted into t1up_lk by the reverse operation that uses the table A of the double-sided print mode.

Depending on the length of the photosensitive member stop time and to which print mode the switch is made, converting the VL UP amount immediately after the start of the photosensitive drum rotation into t1up_lk through reverse operation may not be possible. In such cases, the VL UP amount is fixed to the VL UP amount value immediately after the start of the photosensitive drum rotation, instead of calculating the VL UP amount with the use of the table A. This substantially does not pose a problem if the calculation based on the photosensitive member stop time is performed again at the time when the photosensitive drum 1 stops rotating in the next time.

The table A may be a table dedicated to a specific print mode. Similarly, the image forming apparatus may have the table B that is dedicated to the single-sided print mode and the table B that is dedicated to the double-sided print mode, and the same applies to the table C.

In the double-sided print mode, effects similar to those in the single-sided print mode are obtained by multiplying a table of the single-sided print mode by a coefficient.

A method of calculating VL DOWN fluctuations will be described below. Fluctuations due to VL DOWN are calculated by referring to a VL DOWN table 28 for the single-sided print mode and a VL DOWN table 30 for the double-sided print mode, which are stored in the storing means 20 as illustrated in FIG. 1.

The VL DOWN tables include a table D, a table E, and a table F as illustrated in FIGS. 8A, 8B, and 8C. The amount of VL DOWN fluctuations with respect to the photosensitive member rotation time is calculated based on those tables. The table D illustrates the amount of VL fluctuations with respect to the photosensitive member rotation time t1dw as illustrated in FIG. 8A. The table E illustrates, in a 4×4 matrix, coefficients that are selected based on conditions at the start of image formation (temperature Tc and absolute humidity W of the atmospheric environment) as illustrated in FIG. 8B.

The table F illustrates coefficients that are selected based on the photosensitive member stop time t2. This means that the risen temperature of the photosensitive drum returns to a temperature closer to the original temperature (i.e., temperature of the atmosphere) as the photosensitive member stop time is longer. The amount of VL DOWN fluctuations with respect to the photosensitive member rotation time is calculated by multiplying the amount of the table D by a coefficient selected from the table E. FIG. 8A is a graph and is not in a table format, but the graph is actually kept in a table format in the table D.

As mentioned above, the VL DOWN fluctuation amount ΔD is calculated from three parameters, t1dw (obtained from t1 and t2), W, and Tc. The calculation uses the substantial photosensitive member rotation time t1dw for the same reasons that have been described about VLup.

In this embodiment, the counting of t1 is started after information is reset with t1 set to 0 at the start of one unit of image forming job. This allows for adding the state of the photosensitive member at the start of t1 counting into consideration. Specifically, the state of the VL DOWN fluctuation amount of the photosensitive member (VLdw) is obtained from Vdwend and b. Vdwend represents the value of ΔD at the end of an image forming job that immediately precedes the current image forming job. Represented by b is a correction coefficient obtained from the photosensitive member stop time t2 that is counted from the end of the immediately preceding image forming job to the start of the current image forming job.

A method of calculating the amount of VL DOWN observed while the photosensitive drum 1 is being driven will be described. The VL DOWN fluctuation amount ΔD in the process of image formation is calculated from the photosensitive member rotation time t1dw and the table D. The time t1dw, which is the substantial rotation time of the photosensitive drum 1, has a relation expressed by Numerical Expression 3. In other words, t1dw is the sum of the time t1 elapsed since when the photosensitive drum 1 starts rotating in the current image forming job and t1dw_lk, which indicates the state of the photosensitive member at the time when the current image forming job is started.

$$t1\mathrm{dw}=t1+t1\mathrm{dw}_lk \qquad \text{Numerical Expression 3}$$

where t1 represents the time elapsed since when the photosensitive drum 1 starts rotating in the current image forming job, and t1dw_lk represents a value obtained through a conversion in which the VL DOWN amount of the photosensitive member at the time when the current image forming job is started is calculated back into a time with the use of the table D that has been prepared for the employed print mode.

The VL DOWN amount calculated from the table D is multiplied by a coefficient that is selected from the table E of FIG. 8B based on the temperature Tc and absolute humidity W of the atmospheric environment. The VL DOWN amount ΔD with which the controlling means 23 controls image formation is thus determined.

After the image forming job is ended and the photosensitive drum 1 stops rotating, the calculating means 25 stores Vdwend, which is the VL DOWN amount at the time when the photosensitive drum 1 stops rotating, in the storing means 20, and the timer 24 starts counting the photosensitive member stop time t2. The value of the photosensitive member stop time t2 that is counted from the end of the current image forming job to the start of the subsequent image forming job is used in selecting from the table F of FIG. 8C the coefficient b by which Vdwend is to be multiplied. When the subsequent image forming job is started, VLdw is obtained from the stored Vdwend and the selected b by Numerical Expression 4.

$$VL\mathrm{dw}=b\times V\mathrm{dwend} \qquad \text{Numerical Expression 4}$$

VLdw which is the VL DOWN amount of the photosensitive member immediately after the photosensitive drum 1 starts rotating is expressed by Numerical Expression 4. The value t1dw_lk described in Numerical Expression 3 is one obtained by a conversion in which the amount VLdw is calculated back into a time with the use of the table D that has been prepared for the employed print mode.

A feature of this embodiment is that the VL DOWN amount immediately after the photosensitive drum 1 starts rotating is used in the calculation of t1dw_lk through a reverse operation with the use of the table D that has been prepared for the employed print mode.

Another feature of this embodiment is that the table D that has been prepared for the employed print mode is used in the calculation of t1dw_lk through the reverse operation of the VL DOWN amount. In other words, this embodiment is characterized by varying the control value (table D) for determining image forming conditions, depending on what print mode is employed. For example, in the case where the previous job is performed in the single-sided print mode and the current job is performed in the double-sided print mode, the VL DOWN amount immediately after the photosensitive drum starts rotating is converted into t1dw_lk by the reverse operation that uses the table D of the double-sided print mode.

Depending on the length of the photosensitive member stop time and to which print mode the switch is made, converting the VL DOWN amount immediately after the start of the photosensitive drum rotation into t1dw_lk through the reverse operation may not be possible. In such cases, the VL DOWN amount is fixed to the VL DOWN amount value immediately after the start of the photosensitive drum rotation, instead of calculating the VL DOWN amount with the use of the table D. This substantially does not pose a problem if the calculation based on the photosensitive member stop time is performed again at the time when the photosensitive drum 1 stops rotating in the next time.

In this embodiment, the table D alone has a table dedicated to the single-sided print mode and a table dedicated to the double-sided print mode whereas the same table E and the same table F are used for the single-sided print mode and for the double-sided print mode both. However, the present invention is not limited thereto.

This embodiment prepares the tables D for the single-sided print mode and for the double-sided print mode, separately, but the table D for the single-sided print mode may be multiplied by a coefficient in the double-sided print mode, whereby effects similar to those in the single-sided mode are obviously obtained.

The calculating means 25 uses the above-mentioned methods to calculate the VL UP fluctuation amount with the use of the VL UP tables 27 and 29, and to calculate VL DOWN fluctuation amount with the use of the VL DOWN tables 28 and 30. Based on those calculation results, the controlling means 23 sends information for controlling the developing bias of the developing device 5 to the image forming means. In this embodiment, the developing bias is controlled in a manner that keeps the development contrast (Vcont) constant.

Figures 9, 9A:
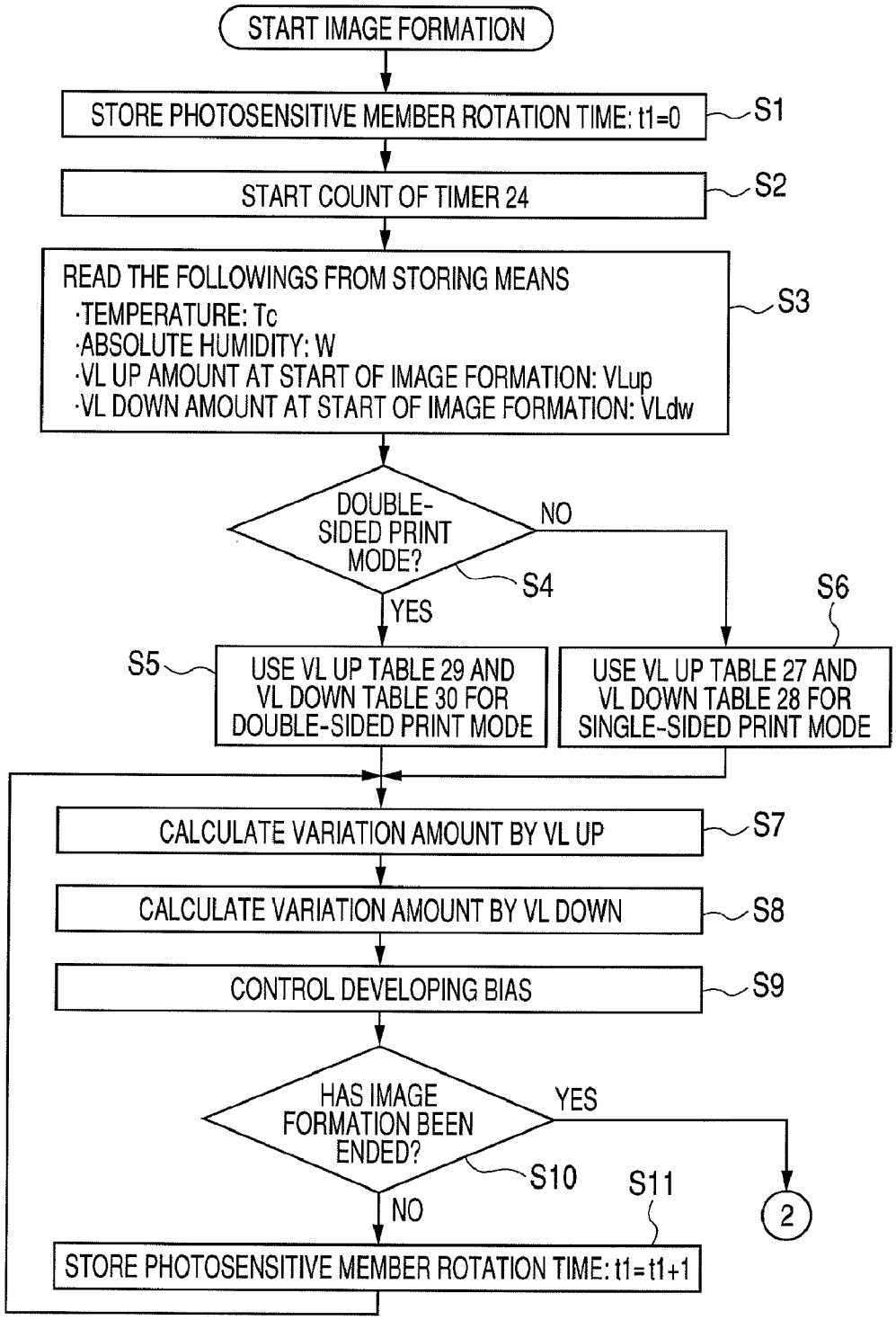
FIG. 9 which is comprised of FIGS. 9A and 9B are flow charts illustrating an operation of the image forming apparatus according to the present invention.
Figure 9B:
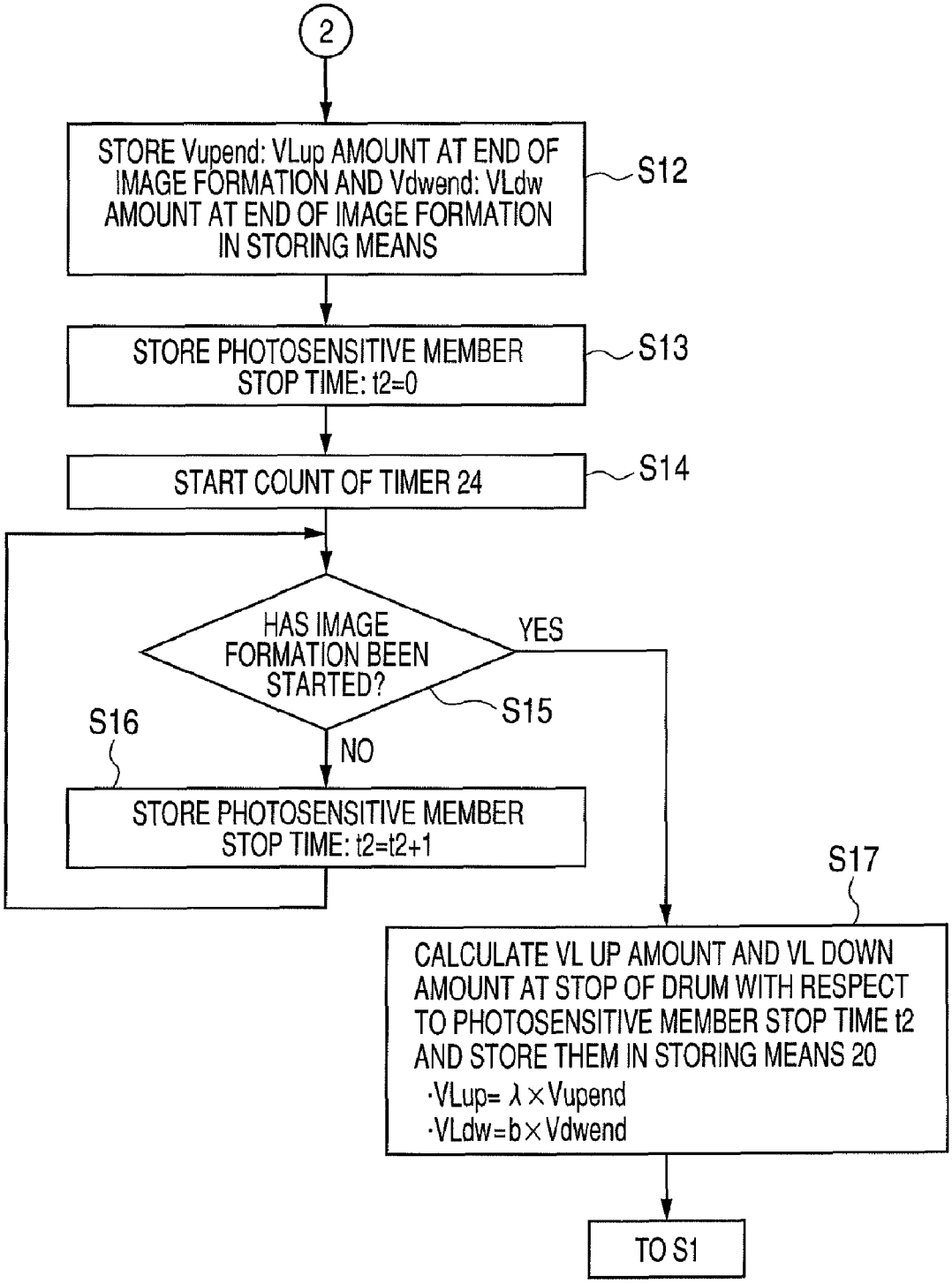

The flow of image formation control of this embodiment will be described below with reference to a flowchart of FIG. 9.

Upon instruction to start image formation, 0 is stored as the photosensitive member rotation time t1 in the storing means 20 in Step S1. In Step S2, the timer 24 starts counting time on the second time scale. In Step S3, the reading means 21 reads the environment temperature Tc, the absolute humidity W, the VL UP amount VLup at the start of image formation, and the VL DOWN amount VLdw at the start of image formation out of the storing means 20. The environment temperature Tc and absolute humidity W read in this step are values that have been read by the temperature and humidity sensor 18 when the image forming apparatus 100 has been powered on, and kept stored in the storing means 20.

In Step S4, the print condition judging means 31 determines whether the single-sided print mode or the double-sided print mode is set as the image forming condition. In the case where the double-sided print mode is set as the image forming condition, the VL UP table 29 for the double-sided print mode and the VL DOWN table 30 for the double-sided print mode are read out of the storing means 20 in Step S5. In the case where the single-sided print mode is set as the image forming condition, the VL UP table 27 for the single-sided print mode and the VL DOWN table 28 for the single-sided print mode are read out of the storing means 20 in Step S6.

In Step S7, the calculating means 25 uses the above-mentioned method to calculate the fluctuation amount ΔU due to the VL UP from the environment temperature Tc, the environment absolute humidity W, the VL UP amount VLup at the start of image formation, and the photosensitive member rotation time t1.

In Step S8, the calculating means 25 uses the above-mentioned method to calculate the fluctuation amount ΔD due to the VL DOWN from the environment temperature Tc, the environment absolute humidity W, the VL DOWN amount VLdw at the start of image formation, and the photosensitive member rotation time t1.

In Step S9, the calculating means 25 uses the fluctuation amount ΔU due to the VL UP obtained in Step S7 and the fluctuation amount ΔD due to the VL DOWN obtained in Step S8 to calculate ΔU+ΔD as the amount of fluctuations in VL. Based on this calculation result, the controlling means 23 controls the developing bias to be applied to the developing device 5 in a manner that keeps Vcont constant.

In Step S10, the CPU 22 determines whether or not the image formation is to be ended. In the case where the image formation is to be continued (Step S10: NO), the timer 24 increases the count of the photosensitive member rotation time t1 by one second in Step S11, and Steps S7 to S10 are repeated until the image formation is finished. In the case where the image formation is to be ended in Step S10 (Step S10: YES), the CPU 22 proceeds to the calculation of the image formation suspension time.

In Step S12, the CPU 22 stores Vupend, which is the VL UP amount VLup at the end of image formation, and Vdwend, which is the VL DOWN amount VLdw at the end of image formation, in the storing means 20.

In Step S13, 0 is stored as the photosensitive member stop time t2 in the storing means 20 and, in Step S14, the timer 24 starts counting time on the second time scale.

In Step S15, the CPU 22 determines whether or not image formation is to be started. In the case where image formation is to remain stopped (Step S15: NO), the count of the photosensitive member stop time t2 is increased by one second in Step S16, and Steps 15 and 16 are repeated until it is time to start image formation. In the case where image formation is to be started (Step S15: YES), the VL UP amount and the VL DOWN amount at the time when the photosensitive drum 1 is stationary are calculated in Step S17 by Numerical Expressions 2 and 4 based on the photosensitive member stop time t2, and stored in the storing means 20. The processing then shifts to Step S1 and subsequent steps, where the calculations for image formation are performed.

A feature of the present invention resides in that the print mode employed in the image formation preceding the subsequent image formation is taken into consideration in changing image forming conditions for the subsequent image formation, instead of the print mode (whether it is double-sided printing or single-sided printing) of the subsequent image formation. This is because a rise in temperature of the photosensitive drum depends on the print mode employed in the image formation preceding the subsequent image formation, not the print mode of the subsequent image formation. VLup and VLdw read in Step S3 are both VL fluctuation amount parameters that are calculated by taking into account the print mode employed in the image formation preceding the subsequent image formation. The VL fluctuation amounts calculated in Step S7 and Step S8 are the same as VLup and VLdw in that the print mode employed in the image formation preceding the subsequent image formation is taken into account.

Next, effects obtained in this embodiment will be described through a comparison between a case in which process control of this embodiment is performed and a case in which process control of this embodiment is not performed (Comparative Example). In Comparative Example 1, none of process control of this embodiment was performed, in other words, the developing bias had a fixed value. In Comparative Example 2, a prediction-control for the single-sided print mode was employed in double-sided printing as described in "Description of the Related Art", without devising process control specific to double-sided printing. The image forming apparatus of the conventional art example has the same structure as that of the image forming apparatus 100 of this embodiment, except that the above-mentioned image formation control is not performed.

Figure 10A:
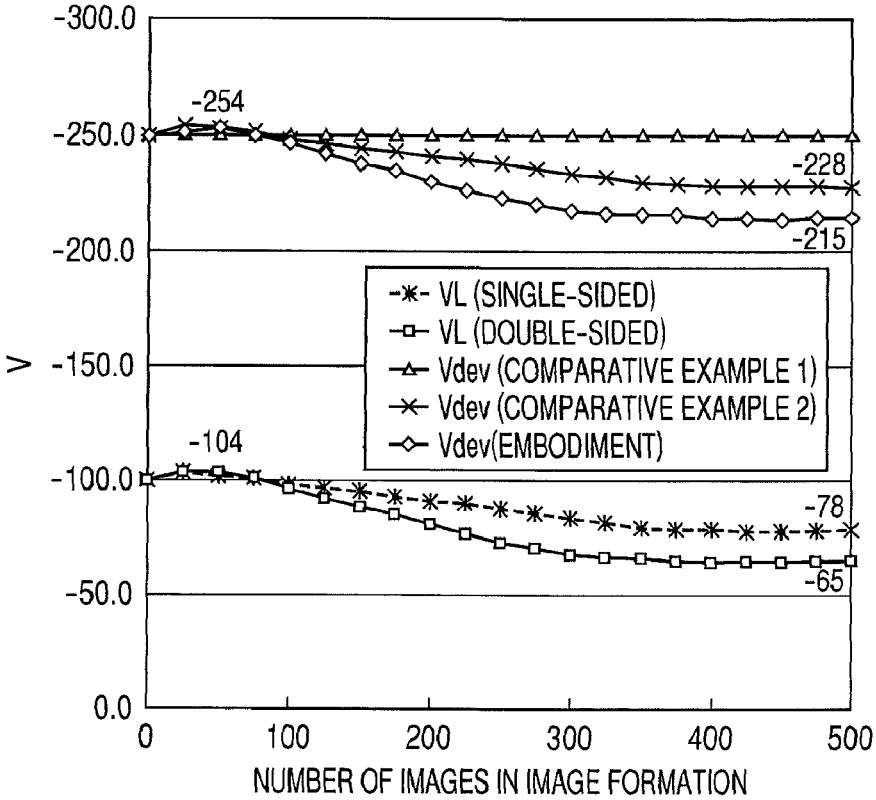
FIGS. 10A and 10B are graphs illustrating the surface potential of the photosensitive drum with respect to the number of images in image formation and an image density with respect to the number of images in image formation when double-sided printing is performed in an L/L environment.

FIG. 10A illustrates the transitions of the developing bias (Vdev) and VL in an L/L environment (15° C., 10% RH, absolute humidity: 1.06 g/m$^3$). The transitions were observed when double-sided image formation is performed on 250 sheets in succession, in other words, when 500 images are formed, after Dmax control and Dhalf control are performed in Comparative Examples and the embodiment of the present invention. The photosensitive member stop time t2 before the start of this image formation operation was 12,000 seconds. FIG. 10A also illustrates as reference data the transition of VL observed when 500 images are formed in the single-sided print mode under the same conditions.

Figure 10B:
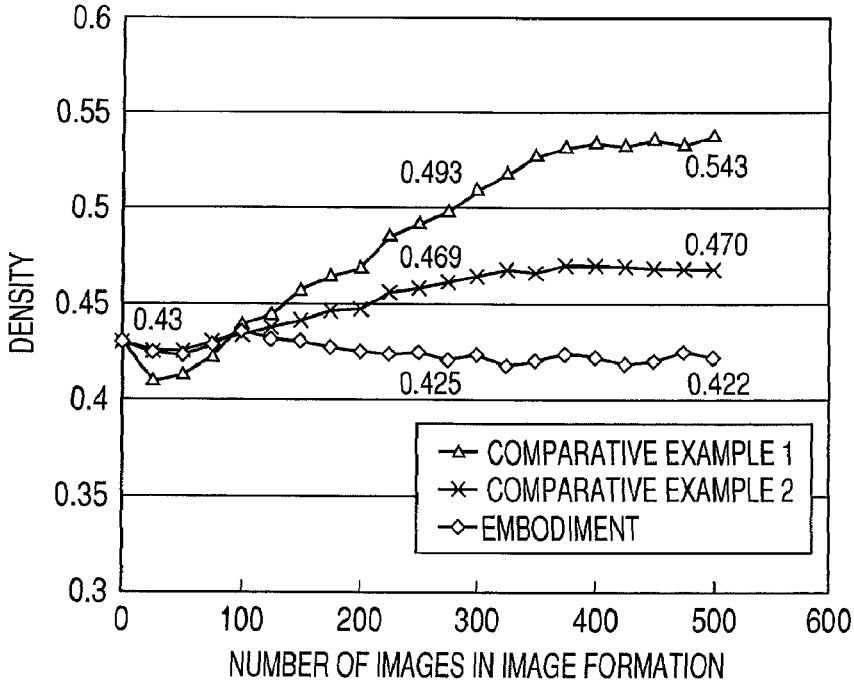

FIG. 10B illustrates the transition of half tone density in this image formation operation. In FIG. 10B, the chromaticity of printed materials was measured as follows:

Toner patches of different colors are formed in ten-level gradations on a transfer material (product name: Color Laser Copier Paper, 81.4 g/m$^2$, manufactured by Canon Inc.) and, after being fixed, the toner patches are measured with GRETAG Spectrolino (product of GretagMacbeth AG). FIG. 10B illustrates as an example the density transition of a magenta, half-tone (coverage rate: 50%) patch.

FIG. 10A illustrates that, when forming 500 images in double-sided printing in the L/L environment, the image forming apparatus 100 of this embodiment has experienced a VL UP of about 3 to 4 V after forming the first 25 to 50 images and then a VL DOWN of about 35 V. The image forming apparatus 100 of this embodiment thus has exhibited characteristics that allow residual charges in the photosensitive drum to cause VL UP once, and then let the increasing influence of the risen temperature of the photosensitive drum keep lowering VL as the number of sheets on which images have been formed increases, until VL saturates.

The VL UP amount in the single-sided print mode is the same as in the double-sided print mode, at about 3 to 4 V after the first 25 to 50 images are formed. However, the amount of the subsequent VL DOWN is about 21 V, which is smaller than in the double-sided print mode.

In this embodiment, the image forming apparatus 100 therefore makes a prediction that leads to such developing bias control that sets the VL DOWN amount is larger in the double-sided print mode.

In Comparative Example 1, a developing bias determined through Dmax control (−250 V) is always used to print images. Therefore, Vcont drops once during the formation of 25 to 50 images. Thereafter, Vcont undesirably rises as the number of sheets on which images are formed increases, and the amount of the rise is about 35 V after 500 images. As illustrated in FIG. 10B, the image density in Comparative Example 1 drops once and then rises as the number of sheets on which images are formed increases, and the amount of the rise is 0.113 per 500 images.

In Comparative Example 2, the developing bias is changed consecutively as the number of sheets on which images are formed increases, but the VL DOWN amount in the double-sided print mode is not taken into consideration. Accordingly, while VL UP after 25 to 50 images is successfully prevented from lowering Vcont, the subsequent rise in Vcont cannot be avoided as the number of sheets on which images are formed increases, because the actual VL DOWN amount is larger than the predicted VL DOWN amount. The amount of the rise in Vcont is about 14 V after 500 images. As illustrated in FIG. 10B, the image density of Comparative Example 2 is prevented from lowering after the first 25 to 50 images and then rises as the number of sheets on which images are formed increases, and the amount of the rise is 0.040 per 500 images.

In this embodiment, on the other hand, the developing bias (−250 V) determined through Dmax control is changed consecutively during printing by calculating VL fluctuations in the double-sided print mode. Vcont can therefore be kept constant irrespective of the number of sheets on which images are formed. As illustrated in FIG. 1A, Vcont fluctuations remain small at a few V throughout the successive printing of 500 images on paper. Accordingly, as illustrated in FIG. 10B, the image density of this embodiment is steady irrespective of the number of sheets on which images are formed, and fluctuates only by 0.017 (from 0.418 to 0.435).

While FIG. 10B illustrates only results of the magenta, half-tone (coverage rate: 50%) patch, it was confirmed that this embodiment is successful in stabilizing density fluctuations in magenta patches of other gradation levels and in patches of other colors. The effects of this embodiment were obtained not only in successive printing, but also in intermittent printing and in printing in which the print mode is switched from double-sided to single-sided. Also in the opposite case where the print mode is switched from single-sided to double-sided, this embodiment was confirmed to be successful in stabilizing density fluctuations.

In this embodiment, the developing bias was controlled based on a prediction of how the surface potential VL of the photosensitive drum 1 fluctuates. Alternatively, the developing bias may be controlled based on a prediction of how the electric potential in a half tone image portion fluctuates.

Developing bias was controlled on the second time scale (on a one second basis) in this embodiment, but may be controlled on other basis. For example, the developing bias may be controlled by five-tenths of one second (on a 0.5 second basis), or by one page (on a one page basis).

In this embodiment, the developing bias was controlled as a way of image formation control for keeping Vcont constant based on a prediction of how VL fluctuates. Alternatively, the charging bias may be controlled. Specifically, Vcont is kept constant by changing the charging bias consecutively based on a prediction of VL fluctuates while keeping the developing bias constant. This is accomplished by storing a table that illustrates the relation between the charging bias and the predicted VL in the storing means 20, and by controlling the charging bias in a manner that keeps VL constant all the time. The charging bias is set low in the case where VL goes up due to ΔU and ΔD, and set high in the case where VL goes down due to ΔU and ΔD.

The above-mentioned method ensures that stable density images can be always obtained even when the charging bias is controlled as a way of image formation control. Alternatively, the charging bias and the developing bias may both be controlled based on a prediction of VL fluctuates.

In this embodiment, a recording material print mode where transfer is performed only on recording materials that have never passed through the fixing device is designated as "single-sided print mode" (first print mode), whereas a mode in which transfer is performed on recording materials including at least recording materials that have passed through the fixing device is designated as "double-sided print mode" (second print mode). However, the present invention is not limited thereto. For example, a case in which a toner image is transferred to recording paper and fixed once in single-sided printing and then another toner image is transferred onto the fixed image may be treated as the second print mode.

As can be seen in FIG. 8A, in this embodiment, ΔD is larger in double-sided printing than in single-sided printing. Accordingly, under the same conditions in terms of temperature and humidity, photosensitive member rotation time, and photosensitive member stop time, the charging bias is controlled to have a larger absolute value in the double-sided print mode than in the single-sided print mode. In the case where developing bias is controlled, the developing bias is controlled to have a smaller absolute value in the double-sided print mode than in the single-sided print mode.

In this embodiment, the temperature and humidity of the atmospheric environment are measured in a period between the time when the image forming apparatus is powered on and the time when the image forming apparatus reaches a stand-by state ready for image formation, and the temperature T and the absolute humidity W are stored in the storing means. This is because the temperature and the absolute humidity at the time when the image forming apparatus is powered on are deemed as substantially equal to the temperature and absolute humidity of the surface of the photosensitive drum 1 at that time. The temperature T and the absolute humidity W at the time when the power is turned on are used in predicting VL fluctuations.

If the temperature and the humidity at the time when the power is turned on differ greatly from the temperature and humidity on the surface of the photosensitive drum 1, VL fluctuations cannot be predicted with accuracy. Therefore, when the temperature and the humidity at the time when the power is turned on obviously differ from the temperature and humidity on the surface of the photosensitive drum 1, the image forming apparatus may choose not to perform the prediction-control of the VL fluctuations. An example of this is a case in which power failure stops the image forming apparatus in the middle of successive image formation and then the image forming apparatus is immediately powered on. In this case, because the image forming apparatus has been forming images, the temperature on the surface of the photosensitive drum 1 is likely to differ from the temperature of the atmospheric environment significantly. Whether or not the temperature and humidity of the surface of the photosensitive drum 1 greatly differ from the temperature and humidity of the atmospheric environment can be determined by, for example, the following structure. Fixing temperature measuring means 14*a* which measures the temperature of the fixing device 14 is provided and measures the temperature of the fixing device 14 at the time when the image forming apparatus is powered on. In the case where the temperature of the fixing device is larger than a given value, it is suspected that the image forming apparatus was stopped in the middle of successive image formation as described above. The image forming apparatus therefore may be set so that, when the temperature of the fixing device at the time when the power is turned on is larger than the given value, the control for changing the image forming conditions depending on the VL fluctuations is not performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2008-138048, filed May 27, 2008 and 2009-092313, filed Apr. 6, 2009, which are hereby incorporated by reference herein in their entirety.

What is claimed is:

1. An image forming apparatus, comprising:

a photosensitive member which has a rotatable surface;

image forming means which forms an image on the photosensitive member;

a time information obtaining device which obtains information about a rotation time and information about a stop time, the rotation time being a period of time elapsed from a time when the photosensitive member in a stop state starts rotating, the stop time being a period of time elapsed from a time when the photosensitive member in a rotation state stops rotating;

a temperature and humidity detecting device which detects information about a temperature and humidity of the image forming apparatus;

a fixing device which fixes a toner image transferred to a recording material; and a controlling device which controls an image forming condition of the image forming means, the controlling device determining the image forming condition for a subsequent image formation based on the information about the rotation time, the information about the stop time, the information about the temperature and humidity, and whether an image formation that precedes the subsequent image formation is performed in a first print mode or a second print mode, wherein the first print mode is a mode in which a recording material that has passed through the fixing device does not pass through a position in which the toner image is transferred to the recording medium, and the second print mode is a mode in which a recording material that has passed through the fixing device is allowed to pass through the position in which the toner image is transferred to the recording medium.

2. An image forming apparatus according to claim 1, wherein the first print mode is a single-sided print mode and the second print mode is a double-sided print mode.

3. An image forming apparatus according to claim 1, wherein the image forming means comprises:

a charging device which charges the rotatable surface of the photosensitive member;

an exposure device which forms an electrostatic latent image by exposing the photosensitive member to light; and a developing device which supplies a developer to the electrostatic latent image to form a developer image.

4. An image forming apparatus according to claim 1, wherein the controlling device calculates an absolute humidity based on a temperature and a relative humidity, and wherein the controlling device changes the image forming condition in accordance with the temperature, the absolute humidity, the rotation time, and the stop time.

5. An image forming apparatus according to claim 1, wherein the image forming condition comprises at least one of a charging bias applied to the charging device and a developing bias applied to the developing device.

6. An image forming apparatus according to claim 5, wherein the controlling device comprises a calculating device which calculates a first charging bias correction amount and a second charging bias correction amount, the first charging bias correction amount being used to increase an absolute value of the charging bias, the second charging bias correction amount being used to reduce an absolute value of the charging bias, and wherein the charging bias is controlled based on the first charging bias correction amount and the second charging bias correction amount.

7. An image forming apparatus according to claim 6, wherein the calculating device calculates the first charging bias correction amount so that the absolute value of the charging bias is increased as the rotation time becomes longer, and calculates the first charging bias correction amount so that the absolute value of the charging bias is reduced as the stop time becomes longer.

8. An image forming apparatus according to claim 6, wherein the calculating device calculates the second charging bias correction amount so that the absolute value of the charging bias is reduced as the rotation time becomes longer, and calculates the second charging bias correction amount so that the absolute value of the charging bias is increased as the stop time becomes longer.

9. An image forming apparatus according to claim 6, wherein, in the second print mode, the calculating device calculates the first charging bias correction amount so as to increase the absolute value of the charging bias in comparison with the first charging bias correction amount in the first print mode.

10. An image forming apparatus according to claim 5, wherein the controlling device comprises a calculating device which calculates a first developing bias correction amount and a second developing bias correction amount, the first developing bias correction amount being used to reduce an absolute value of the developing bias, the second developing bias correction amount being used to increase an absolute value of the developing bias, and wherein the developing bias is controlled based on the first developing bias correction amount and the second developing bias correction amount.

11. An image forming apparatus according to claim 10, wherein the calculating device calculates the first developing bias correction amount so that the absolute value of the developing bias is reduced as the rotation time becomes longer, and calculates the first developing bias correction amount so that the absolute value of the developing bias is increased as the stop time becomes longer.

12. An image forming apparatus according to claim 10, wherein the calculating device calculates the second developing bias correction amount so that the absolute value of the developing bias is increased as the rotation time becomes longer, and calculates the second developing bias correction amount so that the absolute value of the developing bias is reduced as the stop time becomes longer.

13. An image forming apparatus according to claim 10, wherein, in the second print mode, the calculating device calculates the first developing bias correction amount so as to reduce the absolute value of the developing bias in comparison with the first developing bias correction amount in the first print mode.

14. An image forming apparatus according to claim 1, wherein the first print mode is a single-sided print mode and the second print mode is a double-sided print mode, and wherein, when conditions of the temperature and humidity, the rotation time, and the stop time remain the same, an absolute value of a charging bias to be applied to a charging device of the image forming means is larger when the image formation that precedes the subsequent image formation is performed in the double-sided print mode than when the image formation that precedes the subsequent image formation is performed in the single-sided print mode.

15. An image forming apparatus according to claim 1, wherein the first print mode is a single-sided print mode and the second print mode is a double-sided print mode, and wherein, when conditions of the temperature and humidity, the rotation time, and the stop time remain the same, an absolute value of a developing bias to be applied to a developing device of the image forming means is smaller when the image formation that precedes the subsequent image formation is performed in the double-sided print mode than when the image formation that precedes the subsequent image formation is performed in the single-sided print mode.

16. An image forming apparatus, comprising:

a photosensitive member which has a rotatable surface;

image forming means which forms an image on the photosensitive member;

a fixing device which fixes a toner image transferred to a recording material; and a controlling device which controls an image forming condition of the image forming means, the controlling device determining the image forming condition for a subsequent image formation based on whether an image formation that precedes the subsequent image formation is performed in a first print mode or a second print mode, wherein the first print mode is a mode in which a recording material that has passed through the fixing device does not pass through a position in which the toner image is transferred to the recording medium, and the second print mode is a mode in which a recording material that has passed through the fixing device is allowed to pass through the position in which the toner image is transferred to the recording medium.

* * * * *